United States Patent [19]

Beal

[11] Patent Number: 5,060,549

[45] Date of Patent: Oct. 29, 1991

[54] SAFETY ROPE FOR CLIMBING AND MANUFACTURING METHOD THEREFOR

[75] Inventor: Michel Beal, Vienne, France

[73] Assignee: Societe Anonyme De Droit Francais Dite : Ets Beal, Vienne, France

[21] Appl. No.: 480,855

[22] Filed: Feb. 16, 1990

[30] Foreign Application Priority Data

Feb. 17, 1989 [FR] France ..... 89 02451

[51] Int. Cl.[5] ..... D04C 1/12

[52] U.S. Cl. ..... 87/6; 87/9; 87/11

[58] Field of Search ..... 87/6, 9, 11, 13, 41

[56] References Cited

U.S. PATENT DOCUMENTS

| | | | |
|---|---|---|---|
| 852,747 | 5/1907 | Thum | 87/9 |
| 958,872 | 5/1910 | Holzhey et al. | 87/9 |
| 1,172,328 | 2/1916 | Wardwell | 87/9 |
| 2,102,829 | 12/1937 | Boivin | 87/11 |
| 2,328,500 | 8/1943 | Salsas | 87/6 X |
| 2,452,228 | 10/1948 | Dawes et al. | 87/6 X |
| 3,073,209 | 1/1963 | Benk et al. | 87/9 X |
| 3,486,409 | 12/1969 | Powell | 87/6 |

FOREIGN PATENT DOCUMENTS 0311199 4/1989 European Pat. Off. .

*Primary Examiner*—Joseph J. Hail, III

*Attorney, Agent, or Firm*—Oliff & Berridge

[57] ABSTRACT

A climbing rope composed of a core of strands surrounded by a braided tubular sheath, whereby the tightness of the sheath determines the stiffness of flexibility of the rope. Most of the rope is flexible because its sheath is loose, while, near its end intended for creating the tying knot, there is a stiff section, i.e., a section whose sheath is tighter than along the rest of the rope. The stiff section is abrasion resistant where the climbing rope passes through the piton closest to the climber.

6 Claims, 2 Drawing Sheets

SAFETY ROPE FOR CLIMBING AND MANUFACTURING METHOD THEREFOR

BACKGROUND OF THE INVENTION

The present invention relates to a safety rope for climbing and the manufacturing method therefor.

In modern climbing, working in difficult passages, climbers frequently fall but generally without serious consequences because they are generally held by a safety rope engaged in a piton, or a snap-link type device affixed to the climbing surface, located below them, the other end of the rope obviously being held by a teammate.

In order for such a fall not to be serious, i.e., for the tug on the rope not to be too sudden, it is necessary for the last piton in which the safety rope is engaged not to be too far below the climber. For this reason, climbers generally do not ascend vertically for more than three to four meters without placing a new piton.

As a result, the three or four meters of rope which follow a length of a few centimeters required for fastening it to the climber constitute the section of this rope which undergoes the most stress since it is always a portion of this section which is in contact with the piton in the event of a fall.

This section of rope, subjected to the most stress, therefore wears out faster than the rest of the rope, so that climbers cut it off when it is worn out and hence too fragile, until the rope becomes unusable because it is too short.

These ropes are generally formed of a core of strands surrounded by a braided tubular sheath, with the tightness of the sheath determining the stiffness or flexibility of the rope.

Although it has been found that stiffer ropes, i.e. those with tightly braided sheaths, withstand the abrasive action of the piton far better, in general climbers prefer flexible ropes which are easier to handle, i.e. ropes with loosely braided sheaths.

SUMMARY OF THE INVENTION

Hence, the present invention relates to a safety rope of the aforesaid type, most of which is flexible because its sheath is loosely braided but which has a section three to five meters long, located near one end, that is made stiffer by braiding its sheath more tightly.

Preferably, between this end of the rope near which the stiffest section is located and the origin of this section, a flexible end section is provided, corresponding to the length of rope needed to create the tying knot, i.e. the knot by which the climber is fastened to his rope.

The length of the end section of flexible rope is a few tens of centimeters.

The ropes are generally made on special machines which braid the sheath around the stranded core at a constant speed, means being provided to set the tightness of the sheath to the desired value.

The manufacturing process for the safety rope according to the invention consists of programming the sheath tightening means as a function of the travel speed of the stranded core to create successive, predetermined lengths of rope with the desired flexible and stiff sections.

BRIEF DESCRIPTION OF THE DRAWINGS

The invention will be explained in detail with the aid of the description hereinbelow referring to the attached schematic drawings which show, as a non-limitative example, one embodiment of the safety rope.

DETAILED DESCRIPTION OF THE PREFERRED EMBODIMENT

Figure 1:
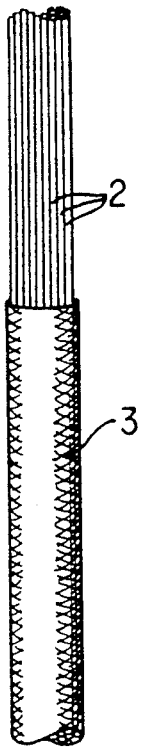
FIG. 1 is a partially cut-away view of a classical type of safety rope.
Figure 2:
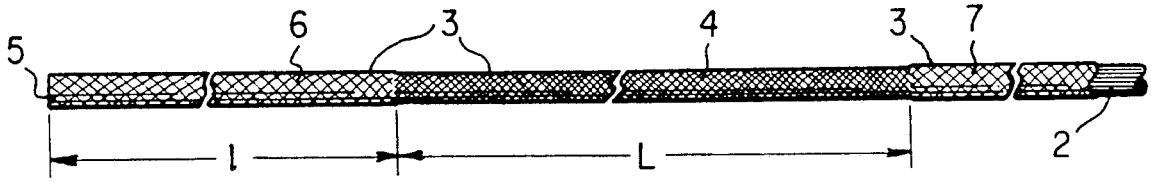
FIG. 2 shows the rope according to the invention on a smaller scale.

As shown in FIG. 1, the rope according to the invention is of the classical type, composed of a core of lengthwise strands 2 bound into a bundle surrounded by a braided tubular sheath 3.

The rope section 4 with a length L of three to four meters located near the end 5 by which the climber is fastened to this rope by means of a tying knot, constitutes the part of the rope subjected to the greatest stress because of the friction generated thereon by the last piton in which it is engaged.

Flexible ropes, i.e., those whose sheath 3 grips stranded core 2 loosely, are preferred by climbers, however stiff ropes whose sheath 3 grips stranded core 2 more tightly have better abrasion resistance at the last piton. But, these stiff ropes are less appreciated by climbers because they are more difficult to handle. Therefore, according to the invention, section 4 of the rope is of the stiff type, with a tighter sheath 3, while the rest of the rope is kept flexible by a looser sheath 3.

This arrangement has the advantages of providing a flexible rope, appreciated by climbers, of which only the part subjected to frictional forces is rigid and hence made more resistant to abrasion stresses.

Preferably, stiff rope section 4 is located at a distance 1 from the end 5 of the rope in order to leave an end section 6 several tens of centimeters in length, i.e. a length corresponding to that required by the climber to create a tying knot.

The remaining part 7 of the rope is made with the same flexibility as end section 6.

Figure 3:
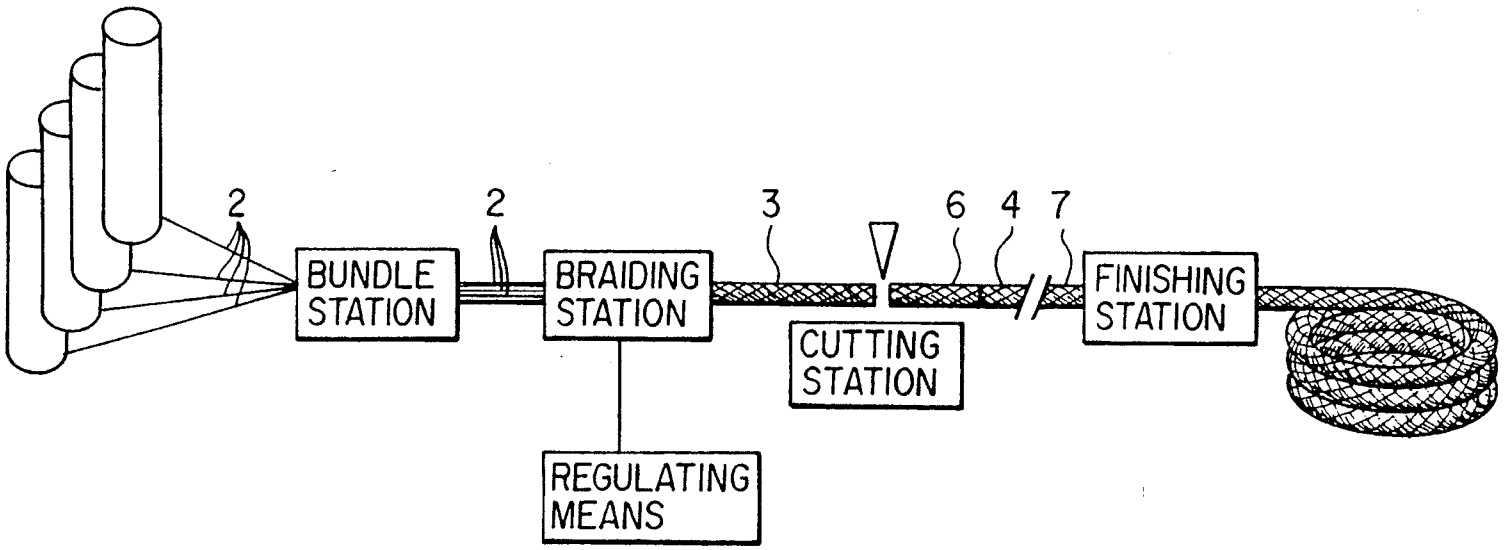
FIG. 3 shows in block diagram the processing steps for creating the rope of the claimed invention.

Since this rope is generally made, as shown in FIG. 3, on automatic machines, that braid the sheath at the same rate as strands 2 are pulled forward, a constant speed, whose sheath braiding elements are provided with means for regulating the tightness of this sheath, it is thus easy to program these means for regulating the tightness sheath 3 in order to create, over a very long length of rope that may later be cut into single ropes, successive series of sections 6, 4, and 7.

What is claimed is:

1. Safety rope for climbing, comprising a core of strands surrounded by a braided tubular sheath, the tightness of the sheath determining the degree of stiffness or flexibility of the rope, said rope having its greater part flexible because of a looseness of the sheath and having near an end intended for creating a tying knot a stiff section whose sheath is tighter than said greater part and said end for said tying knot of said rope.

2. Safety rope for climbing according to claim 1, wherein said stiff section is three to four meter long.

3. Safety rope for climbing according to claim 1, wherein a flexible end section whose length corresponds to that necessary for creating a tying knot is provided between said end intended for creating the tying knot near which said stiff section is located and the end of said stiff section.

4. Safety rope for climbing according to claim 3, wherein said end section is several tens of centimeters long.

5. Safety rope for climbing according to claim 4, wherein said end section is two to five tens of centimeters long.

6. A method for manufacturing a climbing rope comprising the steps of:

bundling a core of elongated strands;

enclosing said elongated strands in a braided sheath;

adjusting the tightness of said braided sheath to create alternating lengths of loosely braided flexible rope sections and tightly braided stiff sections;

cutting said alternating lengths to create said climbing ropes containing a flexible knot tying section, a stiff abrasion resistant section, and a flexible climbing section; and finishing each rope end to prevent fraying.

* * * * *